US005373802A

United States Patent [19]

Krolick et al.

[11] Patent Number: 5,373,802

[45] Date of Patent: Dec. 20, 1994

[54] ATTACHMENT METHOD AND APPARATUS

[76] Inventors: Philip A. Krolick, 12002 22nd St. NE. #2, Lake Stevens, Wash. 98258; Bruce K. Barnard, Box 163A, R.R. 2, Monticello, Ill. 61856

[21] Appl. No.: 941,671

[22] Filed: Sep. 8, 1992

[51] Int. Cl.[5] ..... B63B 17/00

[52] U.S. Cl. ..... 114/347; 114/364; 224/266; 224/273

[58] Field of Search ..... 114/343, 347, 363, 364, 114/354; 224/265, 266

[56] References Cited

U.S. PATENT DOCUMENTS

| | | | |
|---|---|---|---|
| 244,009 | 7/1881 | Wardwell, Jr. | 114/354 |
| 451,579 | 5/1891 | Rinfret | 114/347 X |
| 1,257,073 | 2/1918 | Frank | 114/364 |
| 2,079,868 | 5/1937 | Patch | 114/347 |
| 2,671,231 | 3/1954 | Massicote | 9/1 |
| 3,056,976 | 10/1962 | Craft | 114/363 X |
| 3,139,634 | 7/1964 | Craft | 114/354 |
| 3,795,927 | 3/1974 | Darwin, Jr. | 114/363 |
| 4,016,615 | 4/1977 | Main | 9/1.4 |
| 4,672,911 | 6/1987 | Hodgins | 114/363 |
| 4,768,459 | 9/1988 | Cervenik et al. | 114/363 |
| 4,862,818 | 9/1989 | Sullivan | 114/347 X |
| 4,873,935 | 10/1989 | Lustig | 114/347 |

*Primary Examiner*—Sherman Basinger
*Attorney, Agent, or Firm*—Frederick M. Fliegel

[57] ABSTRACT

An apparatus is described which comprises a rigid element having a length greater than a distance separating gunwales of a boat and a pair of notched elements disposed to either end of the rigid element. The notched elements are adapted to releasably engage the gunwales. The pair of notched elements are held by spring action of the gunwales and sides of the boat when the pair of notched elements are engaged with the gunwales.

15 Claims, 3 Drawing Sheets

ATTACHMENT METHOD AND APPARATUS

FIELD OF THE INVENTION

The present invention is related to an improved method and apparatus for attachment, and more particularly, to an improved method and apparatus for attachment to boats, and yet more particularly, to an improved method and apparatus for attachment to solo canoes.

BACKGROUND OF THE INVENTION

Depending upon the individual and the nature of the application, boating may comprise anything from a leisurely paddle about a lake's shoreline to an extended trip into wilderness areas or other generally inaccessible watercourses. Depending as well on the intended use, a boat or boats are selected to be compatible therewith.

For these reasons, boats are manufactured in a variety of styles, shapes, sizes, weights and/or carrying capacities, and of a variety of natural and/or manufactured materials. The materials employed range through wood to metal, plastics, laminates such as Fiberglass and Kevlar, animal skins, cement, concrete and include composites of any and/or all of the preceding materials as well as other materials.

Further, boats may include a single or a plurality of seats, fixturing to permit rowing, arrangements for attachment of outboard motors, live wells and any of a plethora of devices, appurtenances and attachments found to be convenient for a particular need or desire.

Often a great deal of attention is paid to the weights and strengths of the materials from which the boat or boats are constructed. These points are of especial concern inasmuch as it is often necessary to carry or portage the boat or boats as well as to provide necessary space and/or support for equipment and/or paddlers.

In this latter regard, one of the principal means developed since the inception of the boat and still widely used today is the carrying yoke which the boater employs when portaging the boat or boats from one watercourse to another or where beaver dams, treefalls, waterfalls, dams, seasonal and non-seasonal water level changes and other natural and/or manmade obstacles require recourse to alternative methods of transport such as walking in order to circumvent the obstruction or obstructions.

As most commonly constructed, the yoke comprises a frame assembly attached to a boat and allowing one or more boaters to support and carry a boat upon and/or above the head and shoulders during portage. This method being preferred to dragging or otherwise carrying a boat from a more awkward posture, possibly incurring damage to the boat, ancillary gear and/or persons(s) under portage and which may as well prevent carrying of additional gear and/or supplies, necessitating repeated portaging in order to traverse a particular obstacle or set of obstacles.

Oftentimes a boat is selected to support the needs of a single occupant and in this event the need to be able to carry not only the boat, but as well to simultaneously carry any or all ancillary gear is accentuated. This situation is particularly true with that class of boat known as the solo canoe, i.e., canoes which are designed and intended for use by a single occupant.

In the case of the solo canoe, this problem is particularly pronounced inasmuch as the need for balance during portage requires that the boat be supported from a relatively central location wherein other types of canoes often have a thwart which is frequently relied upon to attach a yoke, either temporarily, semi-permanently or permanently.

Even absent such a central thwart, a yoke may be permanently or semi-permanently centrally attached to tandem canoes, i.e., those canoes designed to accommodate plural occupants.

Such a central thwart is absent in, and further, a yoke may not be permanently or semi-permanently centrally attached to, a solo canoe because the canoeist must of necessity occupy the same central area of the canoe when propelling the boat, to aid forward propulsion by paddling, to enable effective steering and also to allow an appropriate distribution of gear and equipment within the canoe for maintaining balance, et cetera, during travel over water.

As well, experience has shown that this same vital central area of the boat and particularly of the solo canoe is the portion of the canoe from which significant and desirable activities particularly including angling are most successfully and beneficially pursued. Indeed, angling often comprises a core motivation for accessing remote water areas wherein the utility of the solo canoe as a method of transportation is especially and particularly sought.

The absence of a central thwart greatly complicates stable, slippage-free attachment of a yoke without recourse to methods wherein the yoke is secured by means of screws, screw tightened clamps or similar arrangements, affixing the yoke to the gunwales, floor or other portions of the boat. Screws are generally undesirable in a boating accessory because screws can easily be lost without possibility of ready recovery in the water environment and further because screws usually require tools, such as screwdrivers, comprising extra, added weight.

Use of pins, et cetera, requires holes to be drilled or otherwise fashioned which detract from the aesthetic qualities of the boat and which pins or the like may cause difficulty in over-the-road transportation of the boat if they are permanently installed to protrude upward from the gunwales, for example.

It is extremely important that the yoke arrangement be relatively slippage-free during portage because portaging often is accomplished whilst heavily loaded with equipment and further often involves ascent and/or descent of grades under moist or even wet conditions (e.g., wet rocks covered or partially covered with organic matter, mud, and the like) wherein footing and balance are often uncertain at best.

Sudden shifting of weight, such as by way of example the boat, under circumstances of this nature comprises a risk scenario ranging from distinct inconvenience to clear danger of substantial injury to either the portaging person, the boat and/or the accompanying equipment.

Under these circumstances, it is extremely desirable to have and maintain at least one hand free in order to secure balance and so to minimize difficulty in portage. It is thus very undesirable to need to secure the yoke against slippage by having to place one or both hands on the yoke during portage.

Secure, slippage-free attachment of the yoke to the boat avoids a major source of sudden weight shifts which are frequently encountered when portaging with certain types of boat yokes.

It is in regard to the use of the solo canoe that the present invention was conceived and developed and an intent of which is to enable especially and particularly the single individual to easily portage a boat such as a solo canoe, as well as desired and/or necessary ancillary equipment such as by way of example, camping and/or fishing equipment and supplies (e.g., tent, food) without necessity for complex and time-consuming installation and removal of portaging equipment, and, as well, to allow ready access to the vital central portion of the boat during other related boating activities.

More generally, rapid, easy, effective and useful attachment and/or detachment of a boat to another object, such as a fishing rod holder, car top carrier, camera tripod or support, a table such as a food or beverage or specimen collecting or reading or gaming table, recording device platform, spare paddle holder or other accessory without use of tools and with minimum effort is extremely desirable and at present not generally possible or as effective as desired.

What are needed are methods and apparatus which facilitate attachment/detachment of equipment such as portaging gear to boats and especially to solo canoes which methods and/or apparatus do not require use of tools for field installation and use and which apparatus comprises as few separable parts as is possible.

DESCRIPTION OF THE PRIOR ART

U.S. Pat. No. 4,873,935 discloses a combined canoe seat and portage yoke.

U.S. Pat. No. 4,768,459 discloses a canoe seat/carrying yoke comprising a frame assembly including first and second primary support members.

U.S. Pat. No. 4,016,615 discloses a canoe portaging kit including a cushion of soft material which is slipped over a center bar to provide comfort to a person carrying the canoe.

U.S. Pat. No. 2,671,231 discloses a canoe yoke comprising a flexible supporting frame.

The above-noted patents are hereby incorporated herein by reference.

SUMMARY OF THE INVENTION

An apparatus is described which comprises a rigid element having a length greater than a distance separating gunwales of a boat and a pair of notched elements disposed to either end of the rigid element. The notched elements are adapted to releasably engage the gunwales. The pair of notched elements are held by spring action of the gunwales and sides of the boat when the pair of notched elements are engaged with the gunwales.

An apparatus comprises a boat having gunwales and sides, wherein the gunwales and sides comprise a spring, and a rigid element having a length not less than a distance separating gunwales of the boat. The apparatus further comprises a pair of elements disposed to either end of the rigid element and adapted to releasably engage the gunwales. The pair of elements are clamped by spring action of the gunwales and sides of the boat when the pair of elements are engaged with the gunwales.

A method of attachment comprises a step of extending at least a side of an arcuate spring. The at least a side of an arcuate spring comprises at least a side of a boat. The method further comprises steps of inserting an object to be attached and releasing the arcuate spring to clamp the object to be attached.

BRIEF DESCRIPTION OF THE DRAWINGS

The objects, features and advantages of the present invention will be more readily appreciated as the same becomes better understood from the following detailed description when considered in connection with the accompanying drawings, in which like reference characters designate like or corresponding parts throughout the several views, and wherein.

DETAILED DESCRIPTION OF THE DRAWINGS

Figure 1:
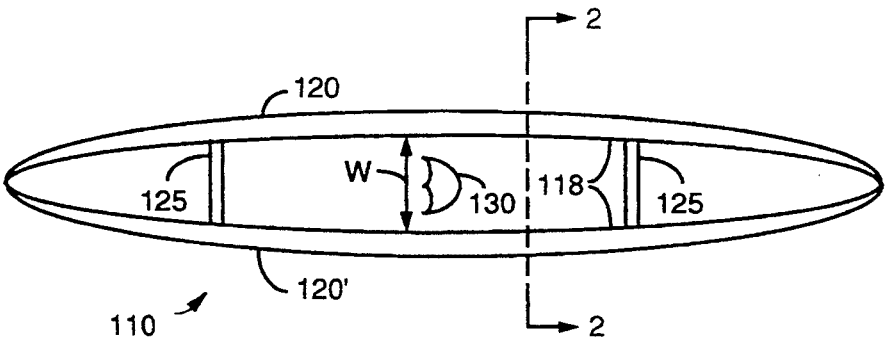
FIG. 1 is a sketch of a plan view of a canoe.

FIG. 1 is a sketch of a plan view of canoe 110. Canoe 110 comprises hull 118, gunwales 120 and thwarts 125 and has seat 130. Hull 118 has gunwales 120 affixed to an upper portion thereof by means of rivets, screws or other fasteners or hull 118 and gunwales 120 may be molded together or attached by glue or similar arrangements. Hull 118 may be constructed of wood, animal skins, metal, plastics, laminates such as Fiberglass TM and Kevlar TM, cement, concrete and/or composites of any or any combination of the preceding or other materials, however, laminates are preferred for light-weight, durable construction.

Canoes such as 110 wherein laminated materials are used for construction of hull 118 often have gunwales 120 comprising aluminum, plastic, wood or other materials. Thwarts 125 are typically affixed to gunwales 120 by screws, rivets or other fastening arrangements and help to support hull 118 against water pressure.

Attachment of seat(s) 130 to hull 118 and/or gunwales 120 is typically achieved by rivets or screws or by gluing or molding them together with hull 118 or otherwise affixing them thereto or placing them therein.

Canoes such as 110 are readily available from a variety of manufacturers, such as, by way of example and not intended to be limiting, the Jensen C1W, the Rendezvous, Solitude, Advantage and Encounter Solo Tripper solo canoes from We-Noh-Nah of Winona, Minn. and the Starlight, Autumn Mist, Summersong and Shock Wave solo canoes available from Sawyer of Oscoda, Mich.

Applicants have discovered that the sides of a boat such as that illustrated in FIG. 1, and particularly the sides of solo canoes, act together as a powerful, arcuate spring, providing substantial compressive force under appropriate circumstances, such as when the sides are distended. This is especially true of solo canoes wherein a large degree of tumblehome (a more pronounced arcuate shape having a greater degree of curvature thereto; see FIG. 2, infra) is incorporated into hull 118 and where further materials such as glass fiber or mat composites are often deliberately employed in hull construction to provide hull flexibility whilst minimizing total boat weight.

Applicants have further discovered that when rigid or semi-rigid gunwales 120 are employed together with a flexible hull, an interior enlipment often results which facilitates a pressure or snap-fit of an accessory such as a yoke device to a canoe, providing a ready means for affixing an accessory such as a portaging yoke to a boat without requiring tools or a plurality of detachable parts and enabling sturdy and slippage-free use of the accessory, even during such vigorous handling as is required during, by way of example, portage.

Figure 2:
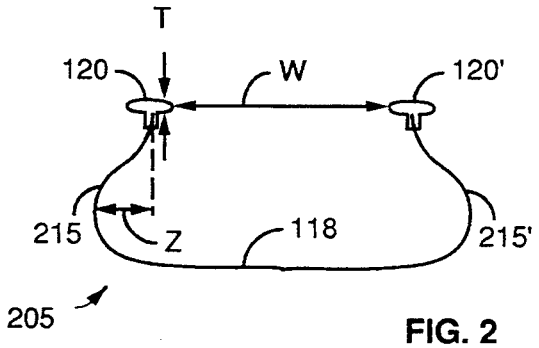
FIG. 2 is a sketch of an enlarged side view, in section, taken along section lines 2—2 of the canoe illustrated in FIG. 1.

FIG. 2 is an enlarged side view, in section, taken along section lines 2—2 of portion 205 of canoe 110 illustrated in FIG. 1. Portion 205 comprises hull 118 and gunwales 120 of canoe 110. By way of example and not intended to be limiting, hull 118 may comprise laminated materials and gunwales 120 may comprise aluminum. The shape of hull 118 exhibits sides 215 having tumblehome, i.e., FIG. 2 shows bulged sides 215 extending outward of gunwales 120 by a distance Z. Canoes and especially solo canoes which are designed for speed and carrying capacity tend to incorporate large amounts of tumblehome (i.e., have larger bulges in sides 215 extending farther beyond gunwales 120) than those designed for plural occupants or those wherein paddling convenience and/or efficiency are not primary concerns.

Solo canoes incorporate large amounts of tumblehome (large distances Z) because the occupant is seated in the central area where canoe 110 is widest and because it is necessary for an occupant to be able to reach and stroke water surrounding canoe 110 with a paddle with minimal interference with sides 215 of canoe 110.

Figure 3:
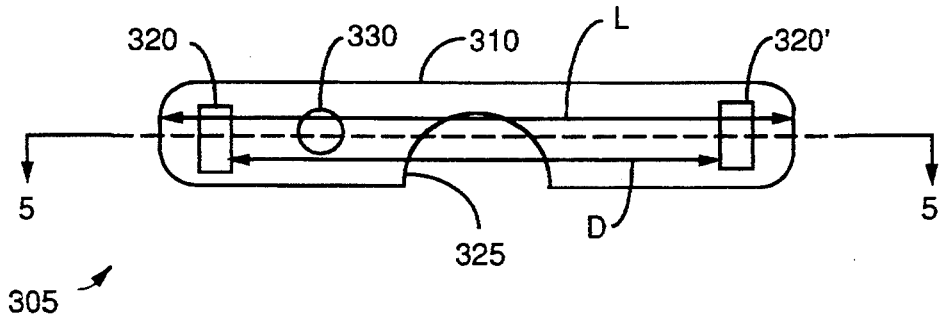
FIG. 3 is a plan view of an apparatus in accordance with a first embodiment of the present invention.

FIG. 3 is a plan view of apparatus 305 in accordance with the present invention. Apparatus 305 comprises a rigid element 310 having a length L exceeding a gunwale to gunwale width W of a boat such as canoe 110 of FIG. 1. Apparatus 305 further comprises a pair of notched elements such as elements 320, 320', separated by a distance D closely approximating width W of FIG. 1. If desired, apparatus 305 may include one or more openings such as 325 and/or 330. Opening 325 may be adapted to accommodate a neck, by way of example.

Opening 330 may, by way of example and not intended to be limiting, be located and adapted to accommodate a butt of a fishing pole or alternatively a beverage container such as a cup. Opening 330 may extend completely through rigid element 310 (e.g., for holding angling apparatus or a tapered beverage container such as a cup) or may extend partially therethrough (e.g., a beverage container holder adapted to a coffee mug, a beer or soda-pop can or a bottle) as appropriate to a specific application.

In the alternative, apparatus 305 may comprise a platform adapted to be a fishing rod holder, camera tripod or support, a table such as, by way of example, a food or beverage or specimen collecting or reading or gaming table, recording device platform, spare paddle holder and any of a plethora of similar devices useful to a person having a boat and including fastening or attachment devices necessary to fulfillment of such functions and which are readily apparent to those of skill in the art.

Figure 4:
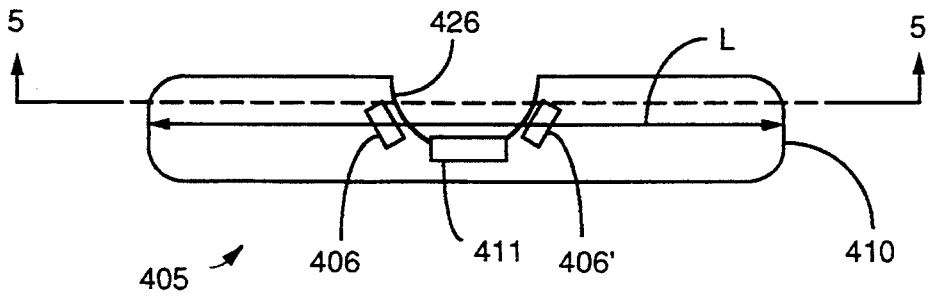
FIG. 4 is a sketch of a plan view of an apparatus comprising a portaging yoke in accordance with a second embodiment of the present invention.

FIG. 4 is a sketch of a plan view of apparatus 405 comprising a portaging yoke in accordance with a second embodiment of the present invention. Apparatus 405 comprises rigid element 410 having length L and notched elements 320, 320' separated by distance D as described (FIG. 3, supra). Apparatus 405 further has opening 426 adapted to accommodate a neck and may include optional pads 406, 406' and/or 411. Pads 406, 406' allow reduction of discomfort to shoulders of a person, for example, during portage. Pad 411 similarly accommodates the back of a neck. Pads 406, 406' and/or 411 may comprise a closed cell foam such as, by way of example, Ensolite TM, a registered trademark (assignor and last listed owner: United States Rubber Company of New York, N.Y. (assignee: Uniroyal, Inc., New York, N.Y.) and available, for example, from a variety of sporting goods outlets. Alternative materials for pads 406, 406' include a variety of plastic foam products as are well known in the art, horsehair, and in fact any of a broad variety of natural and/or synthetic materials including fibers, woven goods, et cetera, as are well known.

Figure 5:
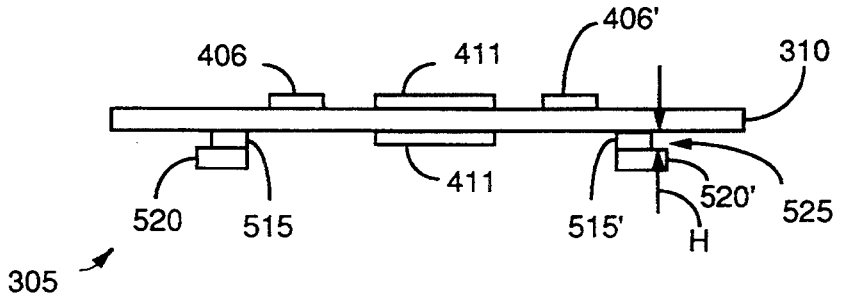
FIG. 5 is a sketch of a side view, in section, taken along section lines 5—5 of the apparatus illustrated in FIGS. 3, 4 in accordance with the present invention.

FIG. 5 is a sketch of a side view, in section, taken along section lines 5—5 of apparatus 305 illustrated in FIGS. 3, 4 in accordance with the present invention. Apparatus 305 comprises elements 515, 520 and 515', 520' comprising elements 320, 320' of FIG. 3. Elements 515, 515' separate elements 520, 520' from rigid element 310 so as to form notch 525 having height H. Height H is comparable to thickness T of gunwale 120 of FIGS. 1, 2. Elements 520, 520' may comprise, by way of example, cleats.

Figure 6:
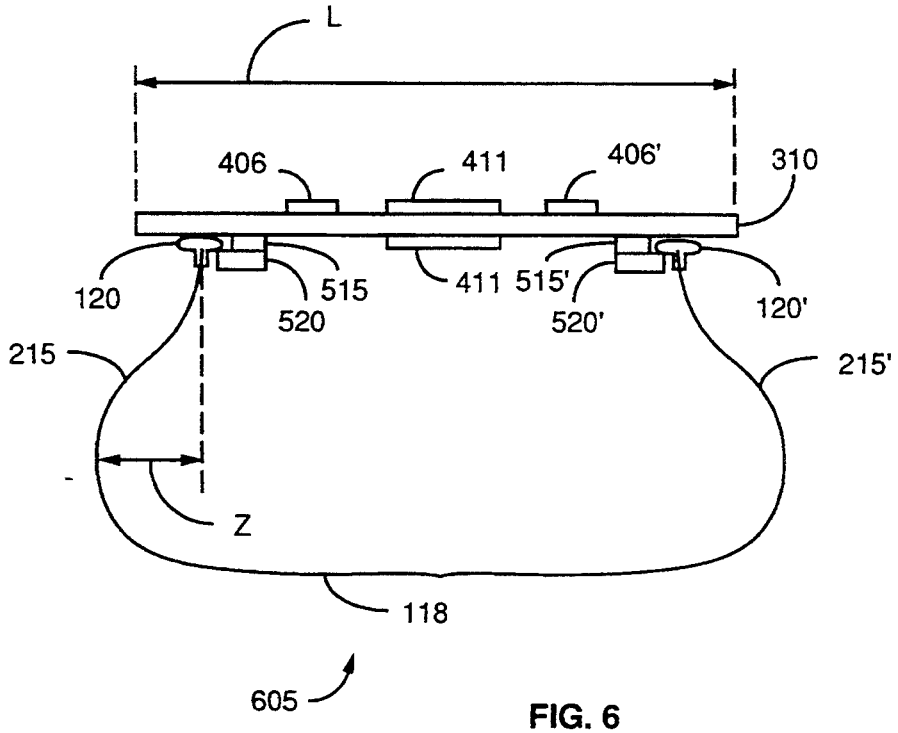
FIG. 6 is an illustration of a side view, in section, of a device such as the device of FIG. 3 attached to a boat such as the canoe of FIG. 1 in accordance with an embodiment of the present invention.

FIG. 6 is an illustration of a side view, in section, of portion 605 of a device such as device 305 of FIG. 3 attached to a boat such as canoe 110 of FIG. 1 in accordance with an embodiment of the present invention. FIG. 6 shows elements 515, 520 and 515', 520' releasably engaged with gunwales 120, 120' and clamped thereby. Attachment of apparatus such as 305 is effected by spreading (distending) sides 215, 215' of canoe 110, for example by application of pressure, insertion of one or both gunwales 120, 120' into notches such as notch 525 of FIG. 5 and subsequent release of sides 215, 215' of canoe 110 to allow the spring action of sides 215, 215' and/or gunwales 120, 120' to clamp apparatus such as apparatus 305 and thereby affix apparatus 305 to canoe 110.

Similarly, release and detachment of apparatus such as apparatus 305 from canoe 110 is effected by reversal of the above-noted procedure. This comprises distending sides 215, 215' of canoe 110, for example by pressing against the inner edges of gunwales 120, 120', lifting apparatus 305 to disengage elements 320, 320' for example, from gunwales 120, 120' and then releasing sides 215, 215' to allow relaxation thereof.

Figure 7:
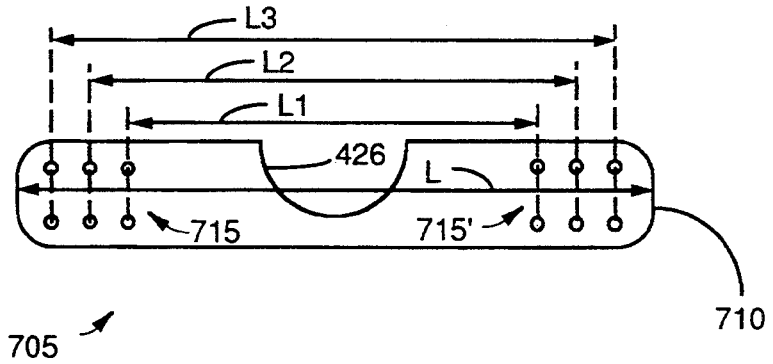
FIG. 7 is a sketch of a plan view of an adjustable apparatus in accordance with another embodiment of the present invention.

FIG. 7 is a sketch of a plan view of adjustable apparatus 705 in accordance with another embodiment of the present invention. Adjustable apparatus 705 comprises rigid element 710 having a plurality of locations 715, 715' separated by distances L1, L2 . . . L3, corresponding to a variety of distances W (FIG. 1, supra) separating gunwales 120, 120' of canoes 110 of differing sizes. Locations 715 correspond to mounting locations for elements such as 320, 320' of FIG. 3 (supra), for example.

Not shown in FIG. 7 for simplicity of understanding are features such as neck opening 325 (FIG. 3), shoulder pads 406, 406' and neck pad 411 (FIG. 4), et cetera, however, relationships between such features and plurality of locations 715, 715' will be readily appreciated and understood by those having skill in the arts to which the instant application pertains.

Plurality of locations 715, 715' may correspond, for example, to pre-drilled holes or marked locations corresponding, by way of example, to specific sizes or makes and models of boat.

Plurality of locations 715, 715' may be used to semi-permanently or permanently attach (by glue, lag bolts, rivets, nails, et cetera, either alone or in combination, for example) elements such as elements 320, 320' of FIG. 3 to adapt, by way of example, apparatus 305 to a specific gunwale separation W. Such adaptation may be performed in a manufactury for producing apparatus such as 305, in a retail outlet where apparatus such as 305 and/or canoe 110 are purchased or obtained or as desired by a user.

Plurality of locations 715, 715' may correspond to a greater or smaller number of locations 715, 715' and these may be arranged in any number of ways, as will be readily appreciated by one skilled in the art. The specific arrangement shown in FIG. 7 is for purposes of ease of illustration only and is not intended to be limiting. Alternative arrangements include, for example, horizontal slots intended to accommodate bolts or other fastening devices (e.g., quarter-turn fasteners) penetrating a given slot and an element such as 320 or 320' and thus allowing an element such as 320 or 320' to be moved laterally along rigid element 705 until such bolts or other fastening devices are tightened to provide fixed attachment of elements such as 320, 320' to rigid element 705 at a desired separation L1, L2 . . . L3 corresponding to a particular gunwale separation W (FIG. 1).

Many other arrangements (i.e., telescoping rods having locking arrangements, a pair of interleaved rigid elements each attached to an element such as 320, 320', wherein the pair of interleaved rigid elements are able to slide relative to one another in a fashion analogous to leaves of a table until locked together at a desired gunwale separation, et cetera,) will be readily apparent to those of skill in the art and are intended to be encompassed by the scope of the description contained herein.

Figure 8:
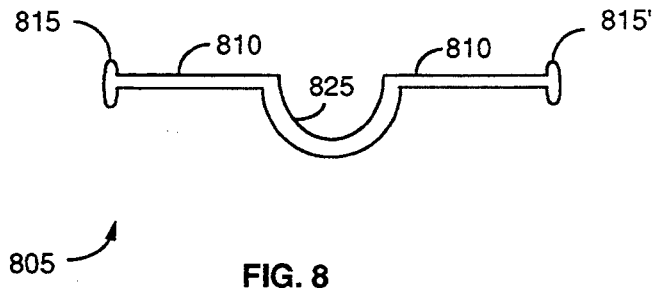
FIG. 8 is a sketch of a plan view of another embodiment of an apparatus in accordance with the present invention.

FIG. 8 is a sketch of a plan view of another embodiment of apparatus 805 in accordance with the present invention. Apparatus 805 comprises a single piece or a set of pieces of, by way of example, rigid molded plastic. Apparatus 805 includes a rigid central member 810 analogous to rigid element 310 of FIG. 3, by way of example, having ends 815, 815' adapted to fit between, for example, gunwales 120, 120' of FIGS. 1, 2 and 6. FIG. 8 does not include details such as beverage holder 330 or neck opening 325 of FIG. 3, or of shoulder pads 406, 406' or neck pad 411 (FIG. 4), for ease of illustration and for clarity of understanding, however, inclusion of such elements into apparatus 805 will be understood by those of skill in the art.

Figure 9:
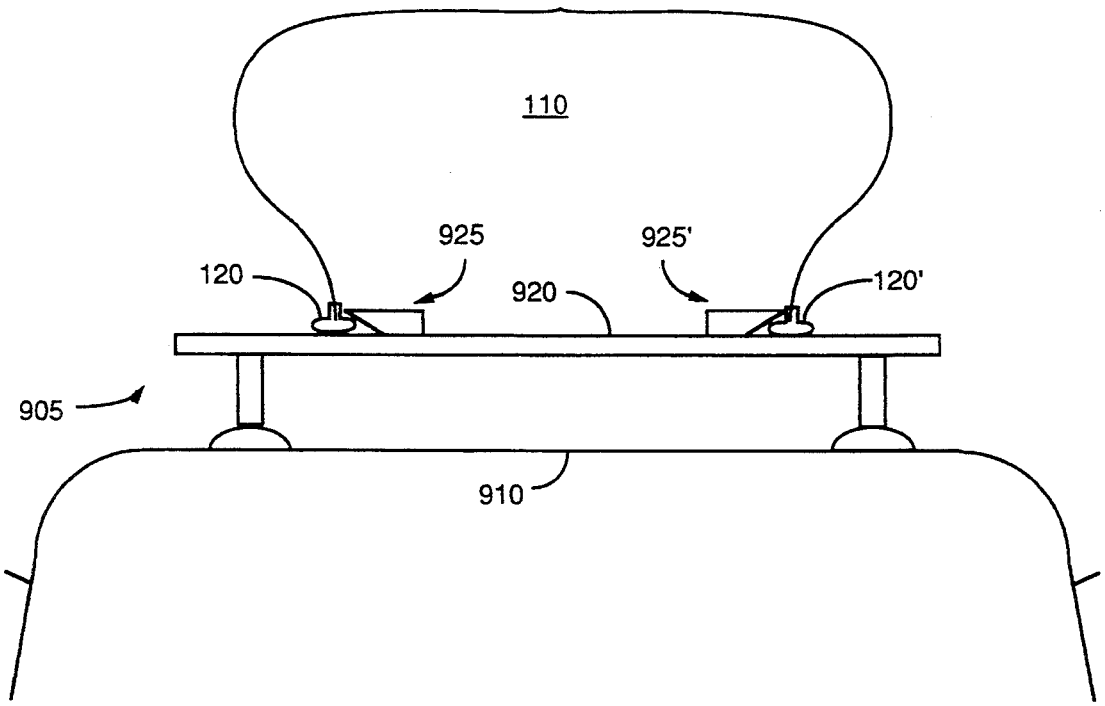
FIG. 9 is a sketch of a side view, in section, of a vehicle-top carrier in accordance with another embodiment of the present invention.

FIG. 9 is a sketch of a side view, in section, of vehicle-top carrier 905 in accordance with another embodiment of the present invention. Vehicle-top carrier 905 provides for mounting or attachment of a boat such as canoe 110 to the top of a vehicle such as a car, truck or van, airplane or boat for transportation over land or water. Vehicle-top carrier 905 comprises an apparatus or a plurality of apparatus such as 305 of FIG. 3 attached to a vehicle top carrier such as a car top carrier. Car top carriers adapted to fit onto and be attached to a top of a vehicle are well known in the art. FIG. 9 illustrates vehicle top 910, vehicle top carrier 905 and apparatus 920. Apparatus 920 is similar and analogous to apparatus 305 of FIGS. 3, 5; 405 of FIG. 4; and 705 of FIG. 7, and is shown having elements 925, 925' (analogous to elements 320, 320' of FIG. 3) facing upwards to receive and attach to or lock onto the gunwales of a boat such as canoe 110 (FIG. 1) when such a boat is mounted thereon in an inverted position.

In some vehicular transportation situations, it may be desirable to mount vehicle-top carrier 905 at an angle or even inverted from the position illustrated in FIG. 9 and apparatus 905 is intended to encompass such variations as may occur to one skilled in the art or necessitated by a specific transport arrangement or vehicle.

The objects, aims intents and purposes of the present invention are seen to have been satisfied, specifically, an ability to provide ease of attachment and/or detachment in boating accessories including portaging apparatus using the spring action of the sides and/or gunwales of a boat to clamp a rigid object have been provided in a simple and rugged hardware arrangement.

More generally, rapid, easy, effective and useful methods and apparatus for attachment and/or detachment of a boat and another object, such as a fishing rod holder, car top carrier, camera tripod or support, a table such as, by way of example, a food or beverage or specimen collecting or reading or gaming table, recording device platform, spare paddle holder or other accessory without use of tools and with minimum effort has been provided in accordance with embodiments of the present invention.

Further provided are methods and apparatus which facilitate attachment/detachment of equipment such as portaging gear to boats and especially to solo canoes which methods and/or apparatus do not require use of tools for field installation and use and which apparatus comprises as few readily separable parts as is possible.

The foregoing description of the specific embodiments will so fully reveal the general nature of the invention that others can, by applying current knowledge, readily modify and/or adapt for various applications such specific embodiments without departing from the generic concept, and therefore such adaptations and modifications should and are intended to be comprehended within the meaning and range of equivalents of the disclosed embodiments.

It is to be understood that the phraseology or terminology employed herein is for the purpose of description and not of limitation. Accordingly, the invention is intended to embrace all such alternatives, modifications, equivalents and variations as fall within the spirit and broad scope of the appended claims.

We claim:

1. An apparatus, comprising:

a rigid element having a length, a width and a thickness, said length greater than a distance separating outer edges of gunwales of a boat; and a pair of notched elements disposed near opposing ends of said rigid element, said notched elements separated by a distance less than said length of said rigid element, said notched elements each comprising a groove extending along said width and adapted to releasably engage said gunwales, said pair of notched elements being held by said gunwales when said grooves are engaged with said gunwales, wherein said rigid element further comprises a pair of shoulder pads disposed on either side of a neckpiece, said neckpiece disposed centrally with respect to said rigid element and adapted to a neck, said pair of shoulder pads adapted to allow said apparatus to rest upon shoulders of a person carrying said boat.

2. An apparatus as claimed in claim 1, wherein said rigid element comprises plastic materials.

3. An apparatus as claimed in claim 1, wherein said rigid element comprises wood.

4. A method of attachment, said method comprising steps of:

extending at least a side of an arcuate spring, wherein the at least a side of an arcuate spring comprises at least a first side of a canoe;

inserting a rigid object to be attached, said rigid object having a length, a width and a thickness, said length exceeding a distance separating outer edges of gunwales of said canoe, said rigid object including grooves disposed near either end of said rigid object substantially along said width; and releasing said at least a side of an arcuate spring to clamp said rigid object to be attached by engaging said gunwales with said grooves.

5. A method as claimed in claim 4, wherein said step of extending includes a step of extending two sides of an arcuate spring.

6. A method as claimed in claim 4, wherein said step of extending includes a step of extending two sides of an arcuate spring comprising sides of the canoe.

7. An apparatus, comprising:

a canoe having gunwales and sides, wherein said gunwales and sides comprise a spring;

a rigid element having a length, a width and a thickness, said length greater than a distance separating outer edges of gunwales of said canoe; and a pair of elements disposed near opposing ends of said rigid element, each of said pair comprising a groove disposed substantially along said width and each groove adapted to releasably engage one of said gunwales, said pair of elements being clamped by spring action of said gunwales and sides of said canoe when said grooves engage said gunwales.

8. An apparatus as claimed in claim 7, wherein said rigid element comprises a carrier for carrying said canoe atop a vehicle.

9. An apparatus as claimed in claim 7, wherein said canoe comprises a solo canoe adapted to accommodate a single occupant.

10. An apparatus as claimed in claim 7, wherein said canoe comprises a solo canoe adapted to seat a single occupant and having a hull including laminated materials.

11. An apparatus as claimed in claim 7, wherein said rigid element comprising an angling device support.

12. An apparatus as claimed in claim 7, wherein said rigid element comprises a base for supporting a camera.

13. An apparatus as claimed in claim 7, wherein said rigid element comprises a canoe portaging yoke.

14. An apparatus as claimed in claim 13, wherein said canoe portaging yoke includes an opening adapted to fit a neck.

15. An apparatus as claimed in claim 14, wherein said canoe portaging yoke includes padding adapted to fit shoulders.

* * * * *